United States Patent [19]

McKay

[11] 4,126,090

[45] Nov. 21, 1978

[54] INKING RING AND WHEEL FOR CODE DATERS

[75] Inventor: James G. McKay, Skokie, Ill.

[73] Assignee: Kiwi Coders Corporation, Wheeling, Ill.

[21] Appl. No.: 800,222

[22] Filed: May 25, 1977

Related U.S. Application Data

[63] Continuation of Ser. No. 669,645, Mar. 23, 1976, abandoned, which is a continuation of Ser. No. 477,654, Jun. 10, 1974, abandoned.

[51] Int. Cl.[2] ..... B41J 3/60; B41F 31/26

[52] U.S. Cl. ..... 101/348; 101/36; 101/329; 101/335; 29/128

[58] Field of Search ..... 101/328–331, 101/333, 335, 348, 349, 369, 36, 37; 29/128

[56] References Cited

U.S. PATENT DOCUMENTS

| | | | |
|---|---|---|---|
| 2,006,364 | 7/1935 | Morse | 101/349 |
| 2,890,654 | 6/1959 | McKay | 101/367 |
| 3,812,782 | 5/1974 | Funahashi | 101/367 |

*Primary Examiner*—William Pieprz

*Attorney, Agent, or Firm*—Silverman, Cass & Singer, Ltd.

[57] ABSTRACT

An inking ring and wheel for code daters, the ring being formed as an elongate length of ink absorbent strip material of generally rectangular cross-section arranged secured end to end to define a ring, said ring being seated in a thin wall U-shaped shell whereby the outer portion of the ring extends radially from the shell so that a portion thereof is disposed outward of the shell. Preferably, the strip is formed of foam rubber and the shell is formed of uncured rubber. A slurry of a solvent and uncured rubber is used as an adhesive for joining the ends of the strip, as well as the strip to the shell. The assembly is vulcanized to effect permanent securement. The thus formed inking ring is mounted upon a cylindrical hub and a pair of side plates retained thereon on both sides of the inking ring to define an inking wheel.

3 Claims, 9 Drawing Figures

24'

INKING RING AND WHEEL FOR CODE DATERS

This is a continuation of application Ser. No. 669,645 filed Mar. 23, 1976, said application being a continuation of application Ser. No. 477,654 filed June 10, 1974 now both abandoned.

FIELD OF THE INVENTION

This invention relates generally to inking devices for code daters and more particularly provides a rotary inking ring and wheel for a rotatable inking device which has an improved ink capacity, is economical to manufacture and to re-ink and it is capable of being easily and cleanly installed upon presently available rotary inking devices.

In U.S. Pat. Nos. 2,562,627 issued July 31, 1951 and 2,890,654 issued June 16, 1959, there are described rotary inking devices of the general type with which this invention is concerned. These inking devices have great utility in automatic code dating equipment operative in conjunction with a conveyor system for transporting packages past the equipment in a continuous line to have selected indicia applied thereto during such transit. Such inking devices are installed in operative position adjacent the printing wheel to transfer ink to the printing members continuously as the printing device rotates. Other patents illustrating the general type of inking devices with which this invention is concerned are described in U.S. Pat. Nos. 2,887,047 and 2,701,519 as well as others issued to the present Applicant.

In many devices of this general character it has been desirable to provide an inking ring of some type of material which is absorbent, which can be pre-inked and which ring is capable of being mounted upon a hub. The intention, of course, is to provide a disposable inking ring. Such a disposable ring has much advantage, but its principal characteristic of disposability is a disadvantage in most usage in that it cannot be re-inked once depleted. Presently available pre-inked rings are very short-lived and the handling of same is messy. It would be desirable to permit the advantages of a pre-inked member but provide one which is capable of easily loading with ink, clean handling and further which does not permit the ink to be extruded other than at its exposed surface instead of, for example, oozing around the side portions or soaking ink into the wheel. Among other advantages, the availability of an inking ring which could easily and cleanly be removed and replaced from the inking wheel would assure materially reduced downtime of the coding apparatus now required to effect replacement of the exhausted absorbent member of the inking wheel. In addition, the manufacturer and/or user could carry a stock of rings of many different widths instead of being required to carry assembled stocks of inking wheels, as is the present experience. Manufacture of the ink-absorbent members for inking wheels is facilitated with machining steps not required.

SUMMARY OF THE INVENTION

An inking ring and wheel for code daters comprising a ring of absorbent material seated in a thin wall shell, with a relatively small portion of the ring extending radially outwardly of the shell. The shell is a thin walled U-shaped member which is permanently adhered to the ring and is formed of ink impervious material.

DESCRIPTION OF THE PREFERRED EMBODIMENTS

Figure 1:
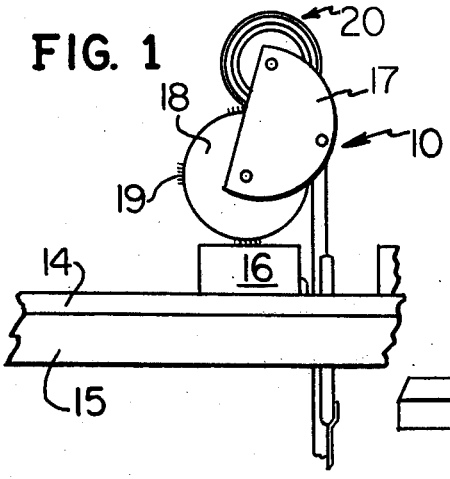
FIG. 1 is an elevational view of a typical code dater device having the inking ring and wheel constructed in accordance with the invention installed as a part thereof, portions being deleted to show interior construction.
Figure 4:
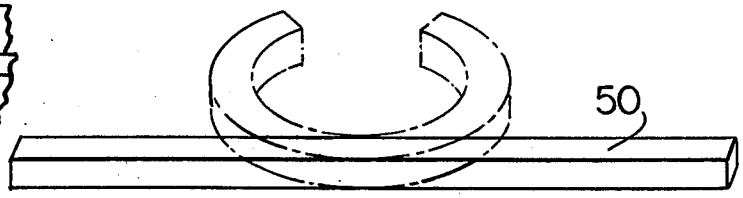
FIGS. 4 to 9 are diagrammatic representations showing progressively a method employed in the fabrication of the inking ring according to the invention.

Referring to the drawing, a representative code dating apparatus designated generally by the reference character 10 is installed in conjunction with a conveyor table 12, the movable reach or table top 14 of the conveyor transporting individual packages or containers in a continously moving line past the apparatus 10 to have imparted thereon selected codifying indicia, such a container 16 being shown passing in printing relation with said apparatus to receive an imprint. For this purpose, the apparatus 10 includes a printing wheel 18 rotatably mounted between a pair of support plates which is shown at 17. The printing wheel 18 is rotated to apply the imprint upon engagement therewith of the moving package 16. The printing wheel 18 carries a plurality of printing members 19 or other printing means such as rubber or metal type members to engage the packages. Spaced above the printing wheel 18 is an inking wheel embodying the invention which has been designated generally by the reference character 20.

It should be understood that the apparatus 10 is illustrative to show the environment in which the inking wheel 20 is suitable for operation and is not intended to restrict the application of the principles of this invention merely to such apparatus. The represented apparatus, however, is sufficient to instruct in the relationship between the printing wheel 18 and the inking wheel 20, it being noted that the inking device is supported between plates for rotation on an axis parallel with and spaced from the axis of rotation of the printing wheel and the periphery of the inking wheel is arranged to contact the protruding type members so as to transfer ink to the type as the printing wheel rotates.

The inking wheel 20 comprises a hub 22 along the rim of which is mounted the inking ring 24. A pair of side plates 23 secured to the hub are retained on opposite sides of ring 24. The inking ring 24 comprises an annular band 26 of ink-absorbent material such as foam rubber. The band 26 is seated within unitary shell 28, the shell 28 being defined by the floor 30 and a pair of opposite side walls 32. The shell is formed of ink-impervious material, such as, for example, unvulcanized rubber. The shell walls defined by the floor 30 and side walls 32 are thin. The band 26 is seated within the shell 28 so that the rim or outer perpherial portion 34 thereof extends outward from the shell from about $\frac{1}{8}$ to $\frac{3}{8}$ inch. The outer circumferential surface 27 of the ring 24 at least is porous, that is without any residual skin sometimes encountered as a result of manufacturing processes for foam rubber strip. The band 26 is permanently secured within the shell 28 so as to form an integral unit. Preferably an adhesive 36 such as a slurry of unvulcanized (uncured) rubber is utilized to effect the permanent adherence of the band within the shell. Preferably, the unvulcanized rubber slurry is formed using a solvent such as Methyl Ethel Ketone, such slurry being a liquid mixture at room temperature. The inking ring 24 is loaded with ink after assembly to form the inking wheel. Loading may be performed by simply rolling the wheel several times upon a tray carrying an ink layer thus forcing ink onto the porous member. The ink loads the porous member generally to the extent of perhaps ¼ inch to ⅜ inch and the thus loaded wheel can be used several months instead of the 1 or 2 days maximum expected life of the available disposable inking rings.

The ring 24 is simply slipped onto the hub disc 22, which has an axial mounting passage 38. The circular plates 23 are arranged on opposite sides of the disc 22. A threaded hollow sleeve 40 is passed through the passage 38 and a pair of hex nuts 42 threadably are engaged on the sleeve 40. A shaft 44 having threaded ends is passed through the sleeve and a pair of hex nuts 46 are mounted at opposite ends of the shaft 44 and cap nuts 48 finish off the assembly. The wheel 20 is freely rotatable on sleeve 40 when assembled.

Figure 5:
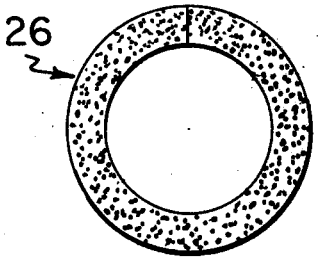
Figure 6:
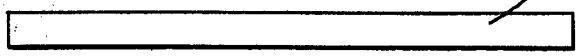
Figure 7:
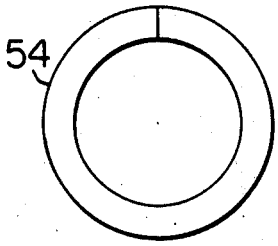
Figure 8:
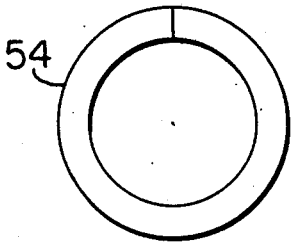
Figure 2:
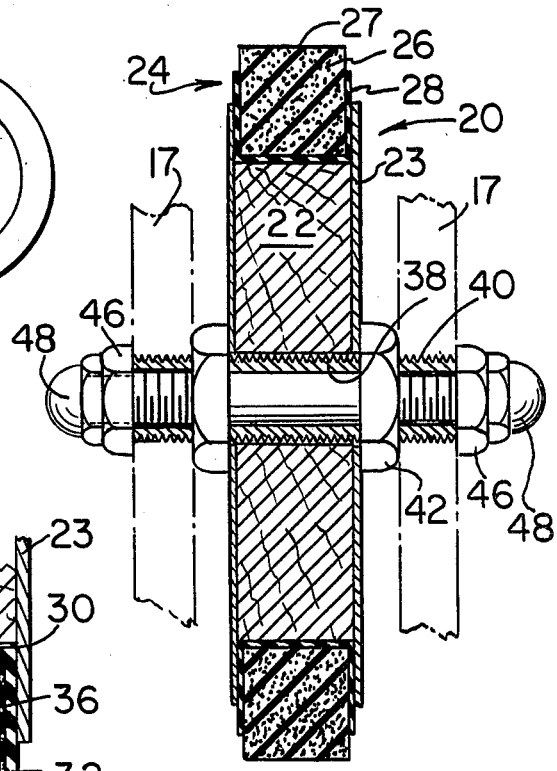
FIG. 2 is an enlarged sectional view taken along lines 2—2 of FIG. 1 and viewed in the direction indicated.
Figure 9:
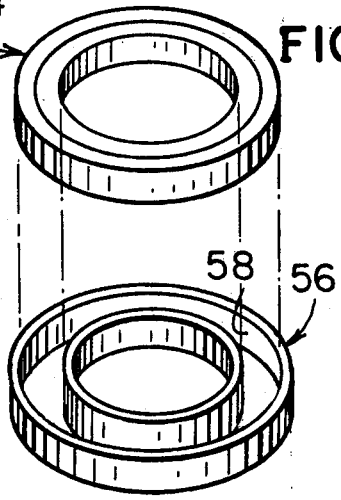
Figure 3:
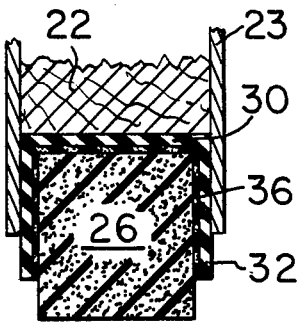
FIG. 3 is a further enlarged fragmentary detail of the inking ring and wheel of FIG. 2.

Referring to FIGS. 4–9, there is diagrammatically stepwise illustrated one method utilized to construct the inking ring 20 of the invention. A flat, generally rectangular cross-section strip 50 of foam rubber is cut to the desired length so that when it is joined end-to-end as shown in phantom view in FIG. 4, the inner diameter of the thus formed ring will approximate the outer diameter of the hub 26 which preferably is a wooden or plastic disc, upon which it is to be mounted. In the embodiment described, the disc has a diameter of 3½ inches. A slurry of Methyl Ethel Ketone and uncured rubber is formed and used as an adhesive which is applied to the ends of the strip so as to hold the same together, as shown in FIG. 5.

A thin, flat strip 52 of 0.010′ thickness unvulcanized rubber is formed of a length sufficient for placement along the inner circumference of the ring defined by the end-to-end connected foam rubber strip, with or without overlap. A pair of circular strips 54 of like-thickness unvulcanized rubber is formed and applied to define the side walls 32 of the shell 28. The strips 54 defining the side walls 32 of the shell 28 are lesser in width than the thickness of the strip of foam rubber so that the outer peripheral portion 34 of the foam rubber extends outwardly of the shell 28. The edges 53 need not be regular, that is even, but the inner diameter of the strips 52 should be regular and closely approximate the outer diameter of the disc 26. The strips of unvulcanized rubber are coated with the slurry and placed in a mold 56 with the band 26, the assembled inking ring 24′ being shown in FIG. 9. Curing or vulcanization of the slurry and unvulcanized rubber strip is effected with the ring within the mold. Heating of the mold 56 with the assembled ring 24′ unit therein at a temperature of 309° F. for a duration of 9 minutes provided a satisfactory inking ring.

Other more sophisticated methods of manufacture are contemplated where the shell can be a thin walled extruded member with the side walls and floor unitary. Such method of manufacture could involve coating the interior of the thus formed shell with the slurry and seating the foam rubber band therein with the ends thereof coated with an adhesive and adhered together.

The mold 56 may comprise a brass ring mold with or without a floor. As an example, brass ring mold having an outer wall and an inner wall is used. The wall height is 0.500 inches, the inner diameter is 4.438 inches and the wall thickness is 0.062 inches. The inner ring is of the same height and thickness, but has a 3.438 inch outer diameter so that the channel defined therebetween has a width of ½ inch, providing a stretch factor, or the hub 26, of about 1/16th inch. The strip of foam rubber cross section selected is ½ inch square. For many purposes wider strips are desirable and in fact may be stepwise up to 6 inches or more, the height of the rings being selected accordingly. The flat unvulcanized rubber strips are formed and cut to size; one of said strips 54 can be placed as a floor lining in the mold should a floor be used. Strip 52 is arranged against the inner wall 58 of mold 56. The said strips are coated with the liquid slurry of unvulcanized rubber. The foam rubber strip ends are coated, joined and inserted in the coated lined mold. The second strip 54 is laid over the strip 54 so as to complete the shell 28. Preferably, the mold and its contents are placed sandwiched between a pair of heat conductive plates (not shown) and heated to a temperature sufficient to vulcanize the unvulcanized rubber. The vulcanizing process is continued sufficient to achieve a rubber durometer measurement after vulcanizing of from 35 to 40. The finished assembly then is removed from the mold in due course. Of course, if the unvulcanized rubber is of the type which is room temperature vulcanizable, heating may not be required.

Preferably the dimensions are selected so that the finished inking ring must be stretched slightly for application to the hub. Of key advantage is the ease of removal of the inking ring from the hub and inking assembly—merely involving slipping one off and a fresh one upon the hub. This can be accomplished without getting ink all over the fingers or other deleterious effects. The rings can be mounted side by side on a wide hub to provide many different width inking surfaces.

What it is desired to secure by Letters Patent of the United States is:

1. An inking device for transferring ink to a printing member in a rolling contact engagement and which comprises:

A. a disc wheel adapted to be mounted on a shaft for rotation, the disc being rigid and having parallel flanges circumferentially arranged defining an annular peripheral channel on the disc wheel, the circumferential surface of said disc defining a hub, B. a resilient expandible inking ring firmly engaged in said channel and confined thereby and having a substantial portion supported by the flanges but protruding beyond the same, said inking ring comprising:

i. an annular generally rectangular cross section member having parallel side walls and formed of cellular, resilient, flexible elastomeric material which is adapted to carry ink applied thereto in interstices and transfer same to a printing member which said cellular member may engage, ii. a channel-shaped cross section, annular, thin-walled shell of vulcanized rubber sheet material having a density substantially greater than that of the cellular material whereby to render the shell ink impervious, the channel configuration opening outwardly to provide a second channel, iii. a thin bonding layer disposed only between the shell and the cellular member, iiii. the shell, bonding layer and cellular member being vulcanized so as to be permanently bonded together with the inner surfaces of said second channel bonded to the inner circumferential surface of the cellular member and to the end surfaces of said cellular member, the resulting composite ring being of such dimensions so as to be capable of being temporarily stretched radially for engagement over said hub then self constrictably returning to effect a firm yet slidable engagement with the circumferential surface of said hub whereby to nest in the first-mentioned channel, C. the lateral walls of the shell having a radial dimension which is substantially less than the radial thickness of the cellular member but greater than the depth of the said first-mentioned peripheral channel so that the radially outer portions of said parallel side walls and the outer circumferential surface of the cellular member extend outward from said shell and said outwardly extending portions being free of said bonding layer whereby when assembled onto the disc wheel, the shell serves as a barrier to prevent transfer of ink from the cellular member to any part of the disc wheel while permitting the circumferential portion of the cellular member freely to function as ink transfer means, said ring being slidably removable as a unit from the hub.

2. A resilient expandible inking ring mountable on the hub of a wheel for rotation therewith and capable of transferring ink to a printing member in a rolling contact engagement, said inking ring comprising:

i. an annular generally rectangular cross section member having parallel side walls and formed of cellular, resilient, flexible elastomeric material which is adapted to carry ink applied thereto in interstices and transfer same to a printing member which said cellular member may engage, ii. a channel-shaped cross section, annular, thin-walled shell of vulcanized rubber sheet material having a density substantially greater than that of the cellular material whereby to render the shell ink impervious, the channel configuration opening outwardly to receive the cellular member, iii. a thin bonding layer disposed only between the shell and the cellular member, iiii. the shell, bonding layer and cellular member being vulcanized so as to be permanently bonded together with the inner surfaces of said shell, bonded to the inner circumferential surface of the cellular member and to the end surfaces of said cellular member, the resulting composite ring being of such dimensions so as to be capable of being temporarily stretched radially for engagement over said hub then self constrictably returning to effect a firm yet slidable engagement with the circumferential surface of said hub whereby to nest on the hub, C. the lateral walls of the shell having a radial dimension which is substantially less than the radial thickness of the cellular member so that the radially outer portions of said parallel side walls and the outer circumferential surface of the cellular member extend outward from said shell and said outwardly extending portions being free of said bonding layer whereby when assembled onto the hub of the wheel, the shell serves as a barrier to prevent transfer of ink from the cellular member to any part of the wheel while permitting the circumferential portion of the cellular member freely to function as ink transfer means, said inking ring being slidably removable from the hub without ink contamination on such removal.

3. The inking ring as claimed in claim 2 where said shell and bonding layer are the resulting products of vulcanization of an uncured rubber sheet material arranged in the configuration of the shell having the cellular member therein and the bonding layer therebetween, the bonding layer being the vulcanized product of a slurry of uncured rubber applied between said shell and said cellular member, the said uncured rubber elements being simultaneously vulcanized after assembly.

* * * * *